US007040928B1

(12) United States Patent
Lai et al.

(10) Patent No.: US 7,040,928 B1
(45) Date of Patent: May 9, 2006

(54) TERMINAL-PROTECTIVE CARD CONNECTOR

(75) Inventors: Yaw-Huey Lai, Taipei (TW); Dong Chu Feng, Huna (CN)

(73) Assignee: Tai-Sol Electronics Co., Ltd., Taipei (TW)

( * ) Notice: Subject to any disclaimer, the term of this patent is extended or adjusted under 35 U.S.C. 154(b) by 0 days.

(21) Appl. No.: 11/194,667

(22) Filed: Aug. 2, 2005

(30) Foreign Application Priority Data

May 30, 2005 (TW) ..... 94208934 U

(51) Int. Cl.
*H01R 24/00* (2006.01)

(52) U.S. Cl. ..... 439/630; 439/945; 439/138; 439/474

(58) Field of Classification Search ..... 439/630, 439/945–946, 138, 474
See application file for complete search history.

(56) References Cited

U.S. PATENT DOCUMENTS 5,862,116 A * 1/1999 Watanabe et al. ..... 720/673
6,641,413 B1 11/2003 Kuroda
6,805,589 B1 * 10/2004 Lee ..... 439/630

* cited by examiner

*Primary Examiner*—Truc Nguyen
(74) *Attorney, Agent, or Firm*—Bacon & Thomas, PLLC

(57) ABSTRACT

A terminal-protective card connector includes a shell and a pressing member. The shell includes at least two (first and second) groups of terminals mounted thereto, and two upright guiding portions formed at two internal sidewalls thereof. The pressing member includes two guided parts formed at two ends thereof and slidably mounted to the two guiding portions, a plurality of through holes formed therein, and at least one bevel formed at a front end thereof. The second group of terminals has contact portions running through bottom sides and then top sides of the through holes respectively to support the terminals of the second group. Thus, a specific group of terminals can be optionally pressed to avoid deformation or short circuit resulted from impact of or contact with uncorresponding cards to be protected.

8 Claims, 8 Drawing Sheets

TERMINAL-PROTECTIVE CARD CONNECTOR

BACKGROUND OF THE INVENTION

1. Field of the Invention

The present invention relates generally to electronic apparatuses, and more particularly, to a terminal-protective card connector.

2. Description of the Related Art

A conventional all-in-one card connector includes a large number of terminals extending into inside space of a shell thereof and corresponding in location to contact pins of various kinds of memory cards, for a variety of electronic cards.

However, because all of the terminals of the aforesaid card connector extend into the inside space of the shell, while an electronic card is inserted into the card connector, the card is subject to friction with or impact on the uncorresponding terminals of the card connector to deform the terminals to further affect the access to the card. In light of this, protecting the terminals becomes a significant issue for improvement of the all-in-one card connector.

As disclosed in the prior art, like U.S. Pat. No. 6,641,413, a slidable member is slidably moved inside a card connector for pressing terminals corresponding to an SD (Secure Digital) card or an MMC (Multi Media Card) card to prevent the terminals from impacting an MS (Memory Stick) card while the MS card is inserted therein.

The present applicant provides a solution of not only protecting the terminals mounted inside the card connector but also being different in technical feature and structure from the above-mentioned patent.

SUMMARY OF THE INVENTION

The primary objective of the present invention is to provide a terminal-protective card connector, which prevents its terminals from deformation or damage incurred by impact of electronic cards uncorresponding to the terminals.

The secondary objective of the present invention is to provide a terminal-protective card connector, which optionally presses a specific group of terminals therein.

The foregoing objectives of the present invention are attained by the terminal-protective card connector, which is composed of a shell and a pressing member. The shell includes an opening formed at a front end thereof, at least two (first and second) groups of terminals mounted to the shell and extending into inside space of the shell, two upright guiding portions formed respectively at two internal sidewalls thereof, and a receiving portion formed at an internal bottom side thereof. The first group of terminals is located at an internal bottom side of the shell. The terminals of the second group each have a part elastically rising upward and a contact portion formed at a distal end thereof. The pressing member includes two guided parts formed respectively at two ends thereof for upward and downward slidable movement, at least one bevel formed at a front end thereof, and a plurality of through holes formed therein. The raised parts of the terminals of the second group contact against and support a bottom side of the pressing member. The contact portions of the second group of terminals run through bottom sides and then top sides of the through holes respectively to expose themselves outside a surface of the pressing member.

The present invention employs the upward and downward movement of the pressing member to press the second group of terminals to optionally press a specific group of terminals and to prevent the terminals from deformation and short circuit incurred by impact and insertion of uncorresponding cards, further effecting the protection of the terminals.

DETAILED DESCRIPTION OF PREFERRED EMBODIMENTS

Figure 1:
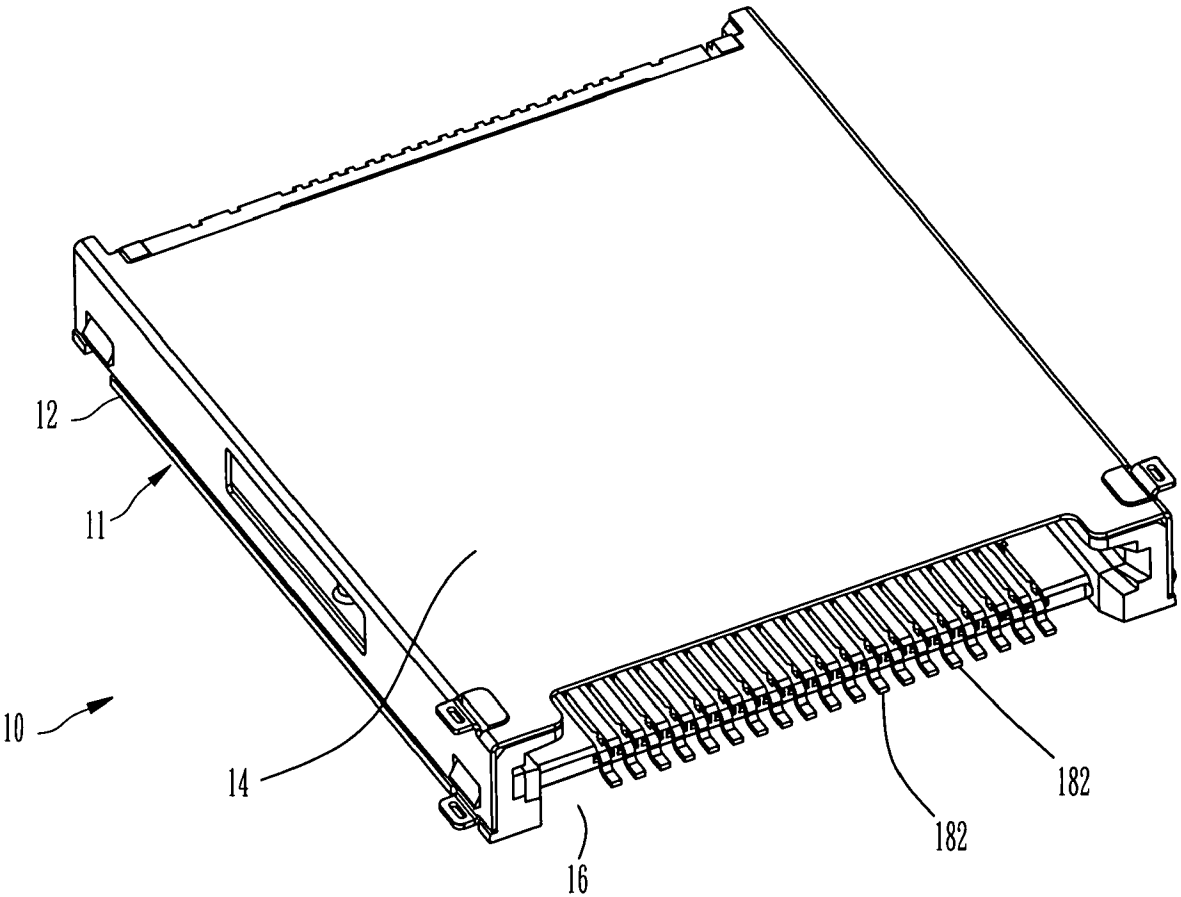
FIG. 1 is a perspective view of a first preferred embodiment of the present invention.
Figure 2:
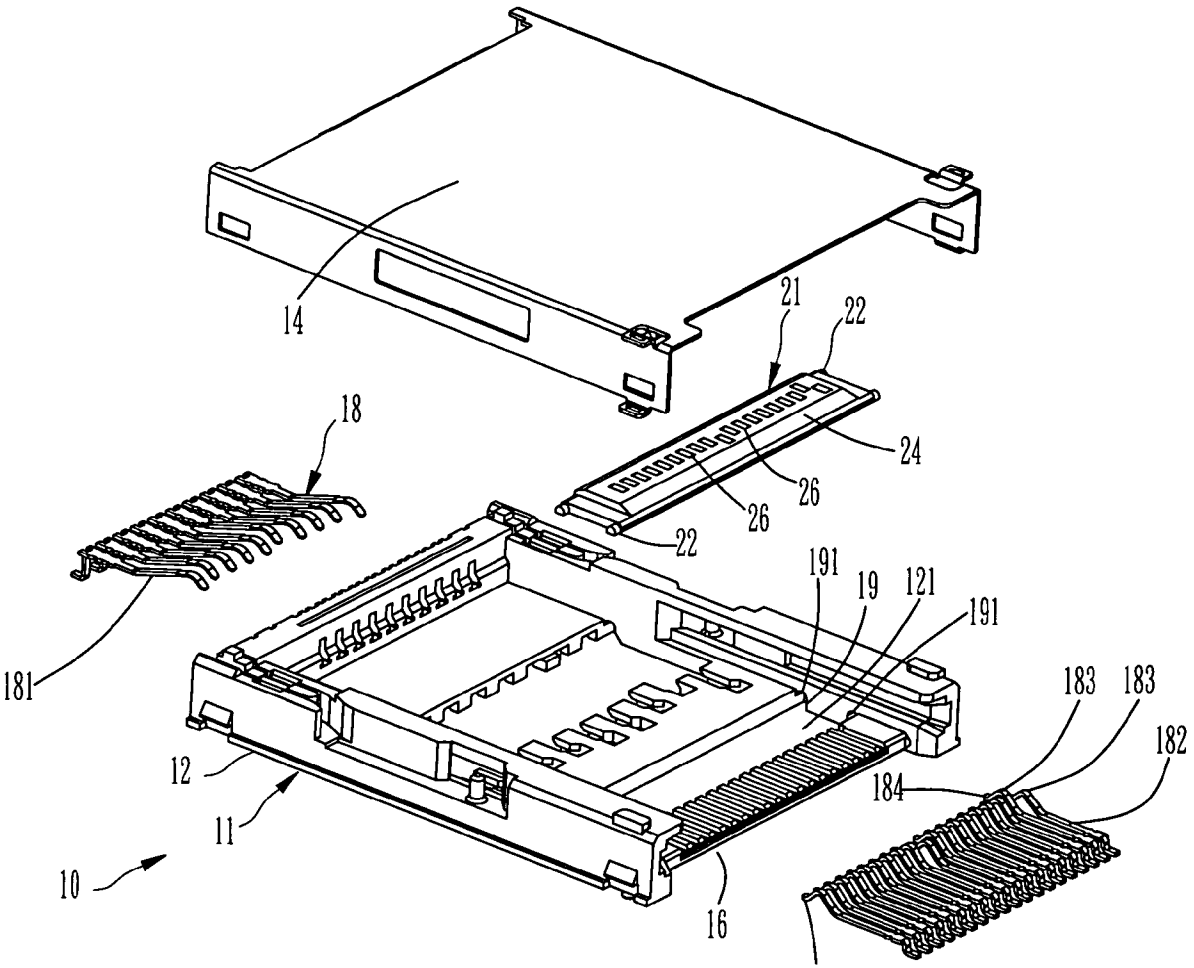
FIG. 2 is an exploded view of the first preferred embodiment of the present invention.
Figure 3:
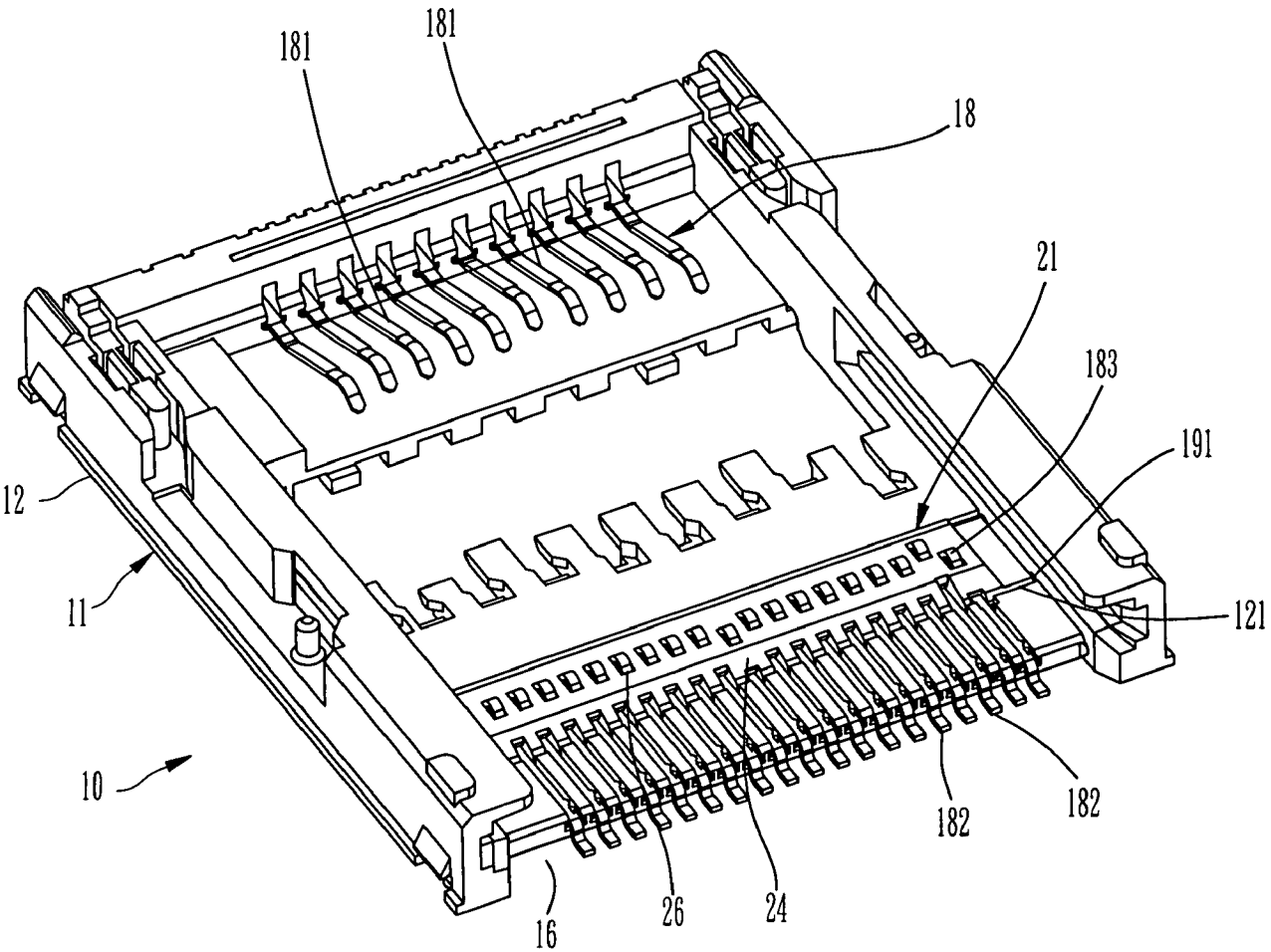
FIG. 3 is another perspective view of the first preferred embodiment of the present invention, from which a cover plate is removed.

Referring to FIGS. 1–4, a terminal-protective card connector 10 constructed according to a first preferred embodiment of the present invention is composed of a shell 11 and a pressing member 21.

The shell 11 includes a base frame 12, a cover plate 14 mounted on the base frame 12, an opening 16 formed at a front end thereof for inserting an electronic card, and at least two groups of terminals 18 mounted to the base frame 12 and extending into inside space defined between the base frame 12 and the cover plate 14. In this embodiment, there are two groups of the terminals 18, i.e. a first group of terminals 181 and a second group of terminals 182. The first group of terminals 181 is located at a rear end of the base frame 12 for corresponding to the MS card. The second group of terminals 182 is located at a top side of the base frame 12 for corresponding to an Extreme Digital (XD) card. Each of the terminals of the second group 182 has a part, which elastically rises upward, having a distal end provided with a contact portion 183 and a support portion 184 extending and bending from the contact portion 183. The base frame 12 has two upright guiding portions 19 formed respectively at two sidewalls thereof. Each of the two guiding portions 19 is defined as two parallel guiding grooves in this embodiment, having a top stop point 191. The base frame 12 has a receiving portion 121 formed on a top side thereof.

The pressing member 21 includes two guided parts 22, at least one bevel 24, and a plurality of through holes 26. The two guided parts 22 are formed at two ends of the pressing member 21 and each are defined as two lugs in this embodiment for received in the guiding portions 19. The bevel 22 extends forward and downward from a front end of the pressing member 21. The terminals of the second group 182 enable the parts and support portions 184 to contact against a bottom side of the pressing member 21 to lift the pressing member 21 and contact against the two guided parts 22 to be limited at the two top stop points 191. The contact portions 183 run through bottom sides and then top sides of the through holes 26 respectively to expose themselves outside a surface of the pressing member 21, received in the receiving portion 121 while the pressing member 21 is moved downward.

Figure 4:
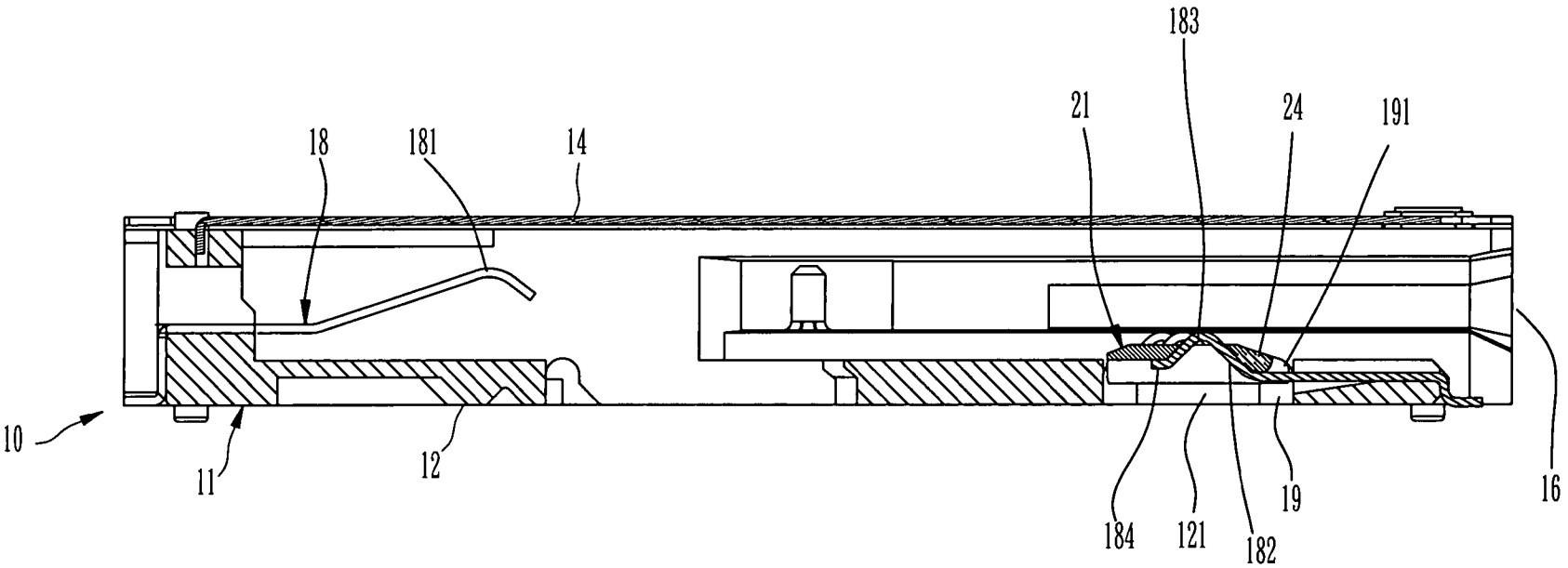
FIG. 4 is a sectional view of FIG. 3.

Referring to FIG. 4, before any card is inserted into the card connector 10, the pressing member 21 is supported by the upward resilience generated from the raised terminals of the second group 182 to rise up to the two top stop points 191 as a limit.

Figure 5:
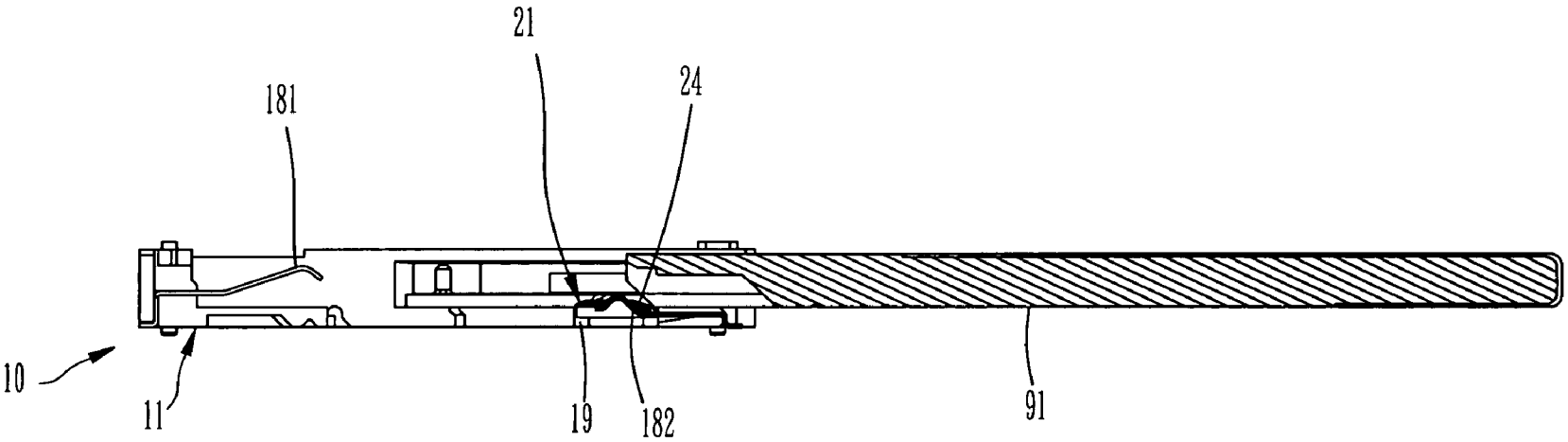
FIG. 5 is another sectional view of FIG. 3, showing that an inserted MS card contacts against a bevel of a pressing member.
Figure 6:
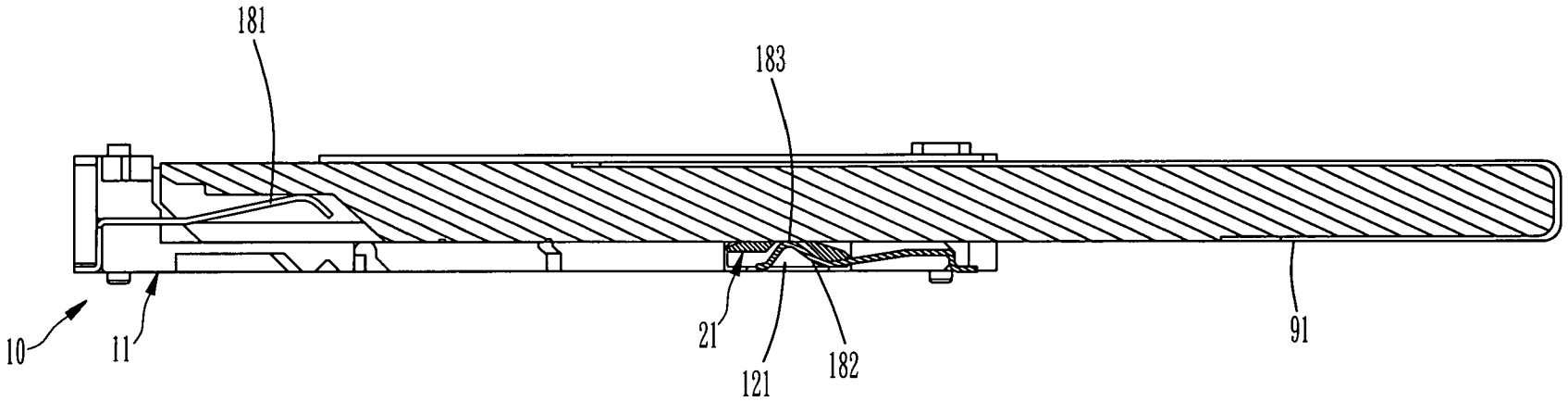
FIG. 6 is similar to FIG. 5, showing that the MS card is fully inserted into the card connector.

Referring to FIG. 5, while inserted into the card connector 10, an MS card 91 has its front end contacting against the bevel 24. Next, while moved further into the card connector 10, the MS card 91 presses the bevel 24 to enable the pressing member 21 to move downward along the two guiding portions 19 to further press the second group of terminals 182. Finally, referring to FIG. 6, the MS card 91 continues to move forward to an internal rear end of the shell 11 to contact the first group of terminals 181, thus completing the insertion of the MS card 91 into the card connector 10. In the meantime, the pressing member 21 is pressed by the MS card 91 to move downward into the receiving portion 121 and to fully press the contact portions 183 of the terminals of the second group 182 into the receiving portion 121 to avoid contact with the MS card 91. As indicated above, during the insertion of the MS card 91, the MS card 91 does not touch the second group of terminals 182 to cause no problem of impact on or damage to or short circuit of the terminals 18.

Before the MS card 91 is being pulled out of the card connector 10; the pulling operation is converse to the insertion operation indicated above; as shown in FIG. 5, the second group of terminals 182 still keep pressed. Until the MS card 91 is moved to a position as shown in FIG. 5, the pressing member 21 gets rid of the pressing and be forced to rise by the upward resilience of the second group of terminals 182. In the meantime, the MS card 91 has its bottom side fully disengaged from the second group of terminals 182 to neither touch nor impact the second group of terminals 182. Thus, while pulled out of the card connector 10, the MS card 91 neither impacts nor touches the second group of terminals 182 such that the terminals 18 can be protected from deformation and damage.

Figure 7:
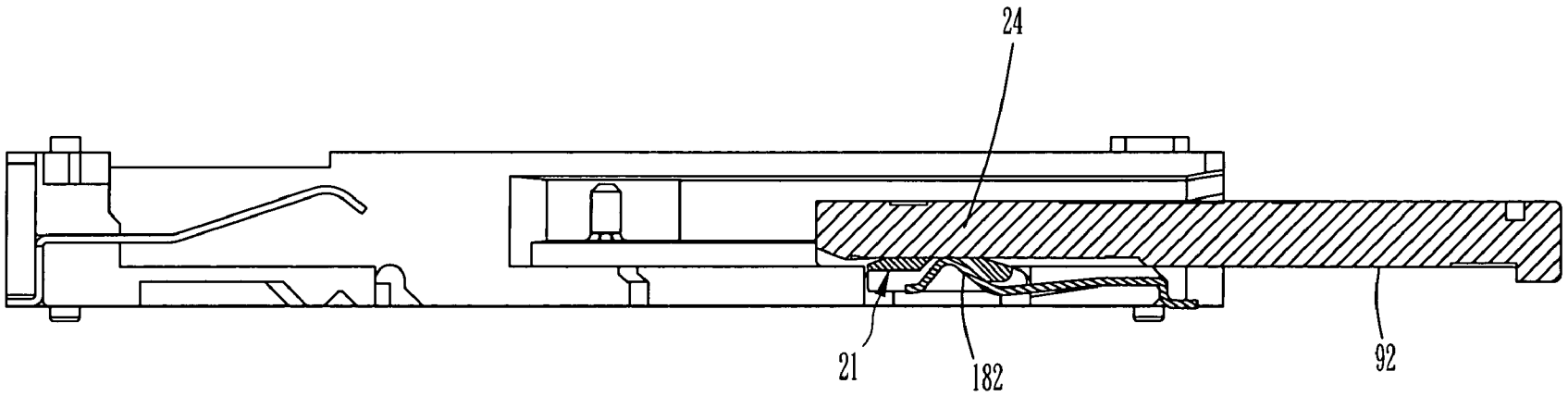
FIG. 7 is similar to FIG. 5, showing that an XD card is fully inserted into the card connector.

Referring to FIG. 7, while an XD card 92 having a recessed portion at its bottom front end is inserted into the card connector 10, the XD card 92 fails to work on the bevel 24 of the pressing member 21 such that the pressing member 21 are not pressed to press the second group of terminals 182 and thus the XD card 92 directly contacts the second group of terminals 182.

Figure 8:
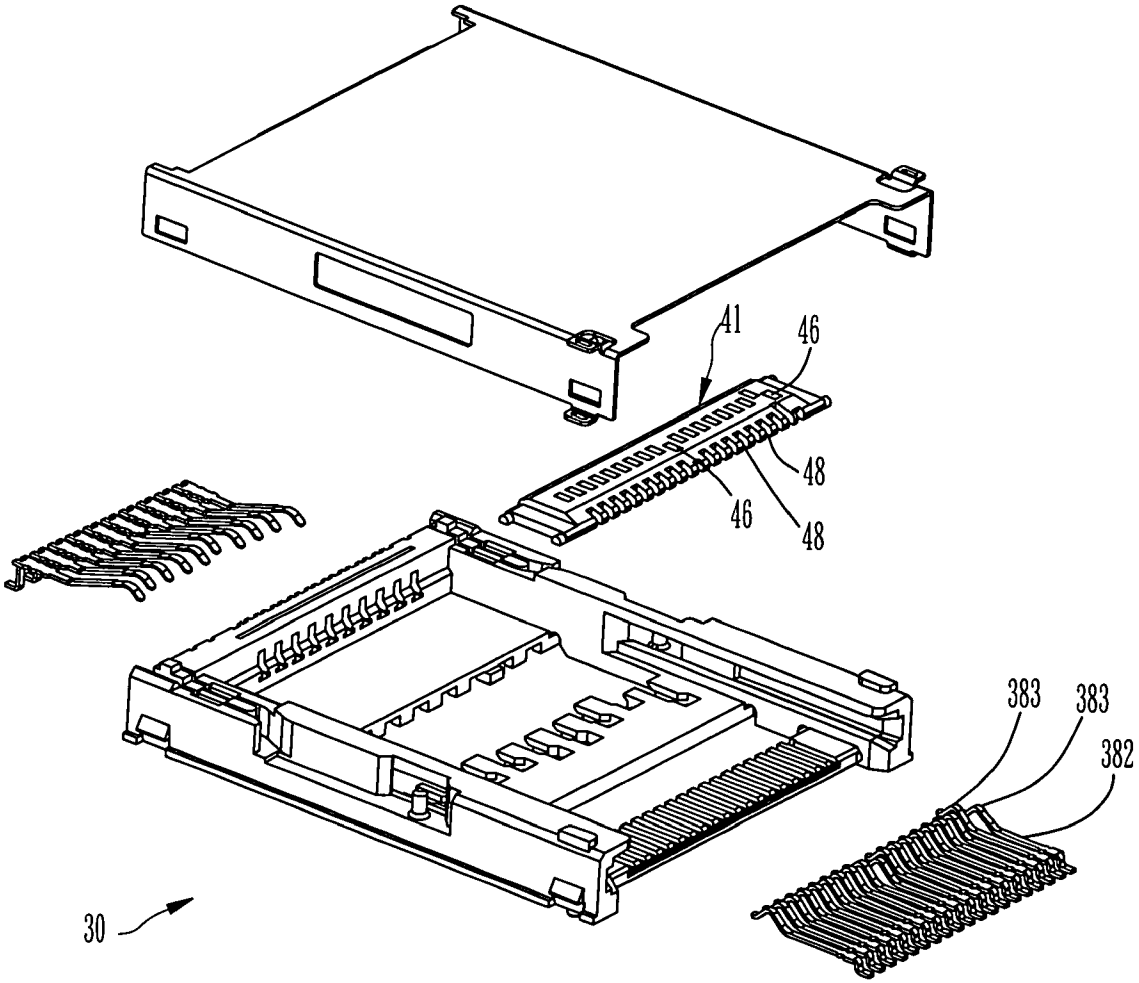
FIG. 8 is an exploded view of a second preferred embodiment of the present invention.

Referring to FIG. 8, a card connector 30 constructed according to a second preferred embodiment of the present invention is similar to the first embodiment but different by that the pressing member 41 includes a plurality of guiding recesses 48 and the second group of terminals 382 is received in the guiding recesses 48.

The operation of the second embodiment is similar to that of the first embodiment, but having difference recited hereafter. During the upward and downward movement of the pressing member 41, the second group of terminals 382 are limited by the guiding recesses 48 to enable the contact portions 383 to be correctly aligned with the through holes 46, thus preventing entry of the contact portions 383 into the through holes 46 from failure resulted from incorrect alignment with the through holes 46.

In conclusion, the present invention includes advantages recited below.

1. Protection of the terminals: The present invention allows the terminals (the second group) for the XD card 92 to be pressed and to avoid impact of the MS card 91 while the MS card 91 is inserted therein, further protecting the second group of terminals from deformation or damage and securing the reliability of operating the card connector.
2. Optional pressing of the terminals: The present invention presses the second group of terminals while the MS card 91 is inserted therein, and does not press the second group of terminals while the XD card 92 is inserted therein, optionally pressing specific terminals while a specific card is inserted, and thus effecting the protection of the specific terminals. In addition, while the MS card 91 having a metallic housing is inserted, the present invention can prevent the second group of terminals from short circuit caused by contacting the metallic housing.
3. Short stroke: The aforementioned slidable member defined in the U.S. Pat. No. 6,641,413 has to be slidably moved for a predetermined distance to lift the terminals for the SD card. The present invention directly enables the pressing member to move downward to optionally press the terminals, having shorter stroke than the port art. Thus, the present invention structurally facilitates the operation of lifting and pressing the terminals and facilitates control of precision.

It is to be noted that the electronic cards shown in the present invention is not limited to the MS card 91 and XD card 92, which are for examples only, but including other kinds of electronic cards structurally similar thereto.

What is claimed is:

1. A terminal-protective card connector comprising:

a shell having an opening being formed at a front end thereof, at least two groups of terminals defined as a first group of terminals and a second group of terminals and mounted in said shell and extending into inside space thereof, two upright guiding portions formed respectively at two internal sidewalls thereof, and a receiving portion formed at an internal bottom side thereof, said first group of terminals being located at an internal rear end of said shell, said second group of terminal being located at an internal bottom side of said shell and each having a part elastically rising upward, said terminals of the second group each having a contact portion at a distal end thereof; and a pressing member having two guided parts and at least one bevel, said two guided parts being formed at two ends of said pressing member and slidably mounted in said two guiding portions, said bevel being formed at a front end of said pressing member and having a plurality of through holes, the parts of said terminals of the second group contacting against and supporting a bottom side of said pressing member, said contact portions running through bottom sides and then top sides of said through holes to expose themselves outside a surface of said pressing member.

2. The card connector as defined in claim 1, wherein said bevel extends forward and downward from the front end thereof.

3. The card connector as defined in claim 1, wherein said shell includes a base frame and a cover plate in cooperation with said base frame.

4. The card connector as defined in claim 1, wherein said terminals of the second group each have a support portion bending and extending from said contact portion, said support portions rising to support a bottom side of said pressing member.

5. The card connector as defined in claim 1, wherein each of said two guided parts of said pressing member has two lugs; said two guiding portions are two parallel guiding slots, said guided parts being received in said guiding portion respectively.

6. The card connector as defined in claim 1, wherein each of said two guiding portions has a top stopping point; said pressing member is supported by said second group of terminals to rise until said two guided parts contact against said two top stop points.

7. The card connector as defined in claim 1, wherein said pressing member includes a plurality of recesses for receiving said terminals of the second group.

8. The card connector as defined in claim 1, wherein said first group of terminals correspond to an MS card; said second group of terminals correspond to an XD card.

* * * * *